US007343884B1

(12) United States Patent
Carney et al.

(10) Patent No.: US 7,343,884 B1
(45) Date of Patent: Mar. 18, 2008

(54) COOLANT SYSTEM FOR HYBRID POWER SYSTEM

(75) Inventors: Allen B. Carney, Vadnais Heights, MN (US); Tommy J. Harder, New Richmond, WI (US); David A. Overland, East Bethel, MN (US); Bradley D. Padget, Richfield, MN (US)

(73) Assignee: Cummins Power Generation Inc., Minneapolis, MN (US)

( * ) Notice: Subject to any disclaimer, the term of this patent is extended or adjusted under 35 U.S.C. 154(b) by 0 days.

(21) Appl. No.: 11/520,464

(22) Filed: Sep. 13, 2006

(51) Int. Cl.
*F01P 9/02* (2006.01)
*F01P 11/02* (2006.01)
*F01P 3/22* (2006.01)

(52) U.S. Cl. ..... 123/41.54; 123/41.27; 123/41.31

(58) Field of Classification Search ..... 123/41.01, 123/41.31, 41.54, 41.27
See application file for complete search history.

(56) References Cited

U.S. PATENT DOCUMENTS 4,352,342 A * 10/1982 Cser et al. ..... 123/41.54
4,510,893 A * 4/1985 Schweiger et al. ..... 123/41.02
4,677,943 A * 7/1987 Skinner ..... 123/41.27
4,739,730 A * 4/1988 Jenz et al. ..... 123/41.54
5,111,776 A * 5/1992 Matsushiro et al. ..... 123/41.54
5,163,506 A * 11/1992 Attinger et al. ..... 165/104.32
5,241,926 A * 9/1993 Sato et al. ..... 123/41.54
5,255,636 A * 10/1993 Evans ..... 123/41.54
5,433,175 A 7/1995 Hughes et al.
5,563,802 A 10/1996 Plahn et al.
5,680,833 A * 10/1997 Smith ..... 123/41.54
6,276,312 B1 * 8/2001 Summan et al. ..... 123/41.54
6,467,286 B2 * 10/2002 Hasebe et al. ..... 62/185
6,616,059 B2 * 9/2003 Sabhapathy et al. ... 237/12.3 B
6,664,751 B1 * 12/2003 Gabriel et al. ..... 318/599
6,708,653 B2 * 3/2004 Lefrancois et al. ..... 123/41.54
6,718,916 B2 * 4/2004 Hewkin ..... 123/41.54
7,082,905 B2 * 8/2006 Fukuda et al. ..... 123/41.31
7,096,683 B2 * 8/2006 Smith ..... 62/200
7,147,038 B2 * 12/2006 Taguchi ..... 165/41

FOREIGN PATENT DOCUMENTS

JP 2004-82921 * 3/2004

* cited by examiner

*Primary Examiner*—Hai Huynh
(74) *Attorney, Agent, or Firm*—Hamre, Schumann, Mueller & Larson, P.C.; J. Bruce Schelkopf

(57) ABSTRACT

A cooling system for a hybrid power system that includes an engine such as a generator engine, and a power converter such as an inverter, includes an engine cooling circuit, a power converter cooling circuit and a common coolant tank operatively coupled to both the engine and the power converter via the engine cooling circuit and the power converter cooling circuit respectively.

21 Claims, 4 Drawing Sheets

COOLANT SYSTEM FOR HYBRID POWER SYSTEM

BACKGROUND OF THE INVENTION

1. Field of the Invention

This invention relates to the field of power generating systems, and more specifically to a coolant system for a vehicular hybrid power system.

2. Description of the Prior Art

A typical vehicular hybrid power system utilizes both a battery stack and a generator engine assembly to develop electrical power. The battery stack can typically be charged from either the generator engine assembly or from shore power. The hybrid system can be used, for example, to generate electrical power for a vehicle such as a recreational vehicle (RV). When utilizing such a hybrid power system onboard a vehicle, problems can arise with the need for cooling the hybrid power system components. Manufacturing costs, maintenance costs, and space requirements are factors that need to be optimized for such a system.

SUMMARY OF THE INVENTION

A vehicular hybrid power system generally includes an engine driven electrical power generator and a bank of batteries to provide a dual source of electrical power, and a power conversion assembly such as, but not limited to, an inverter for converting DC power to AC power. The present invention provides a cooling system that includes a coolant tank operatively coupled to both the generator engine and the inverter assembly. The coolant tank performs a dual function by acting as a generator engine coolant overflow reservoir and as an expansion and pressure head tank for an inverter assembly cooling circuit. The cooling system further employs access to cooling air provided by the engine driven electrical power generator with a heat exchanger and a liquid coolant pumping system to transfer cooling liquid via hoses between the inverter assembly and the engine driven electrical power generator.

The liquid coolant pumping system is turned off during modes when it is unnecessary to cool the inverter assembly, as the inverter assembly is a parasitic load to the available user electrical power. If no coolant is available for pumping, energy management system controls provide a warning or fault condition depending upon predetermined temperatures. The liquid coolant pumping system is turned on whenever predetermined temperatures in the inverter assembly reach desired temperature threshold values.

BRIEF DESCRIPTION OF THE DRAWINGS

Other aspects, features and advantages of the present invention will be readily appreciated as the invention becomes better understood by reference to the following detailed description when considered in connection with the accompanying drawing figures wherein.

While the above-identified drawing figures set forth particular embodiments, other embodiments of the present invention are also contemplated, as noted in the discussion. In all cases, this disclosure presents illustrated embodiments of the present invention by way of representation and not limitation. Numerous other modification and embodiments can be devised by those skilled in the art which fall within the scope and spirit of the principles of this invention.

DETAILED DESCRIPTION OF THE PREFERRED EMBODIMENTS

Figure 1:
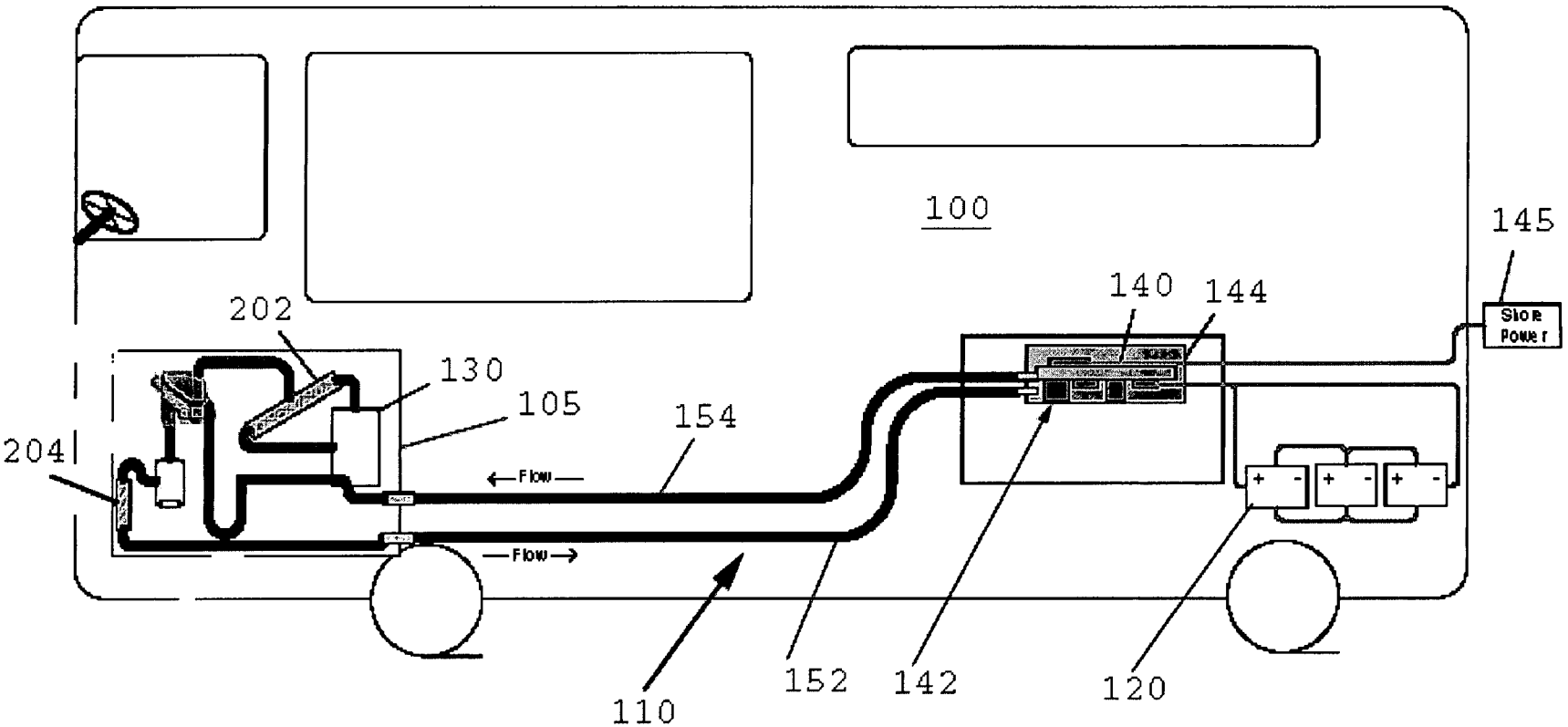
FIG. 1 is a schematic representation of a hybrid power system including a cooling system for the hybrid power system that includes a common liquid cooling tank, in accordance with one embodiment.

FIG. 1 shows a schematic representation of a vehicular hybrid power system and a cooling system 110 for cooling portions of the hybrid power system, in accordance with one embodiment. The hybrid power system is shown integrated within an RV 100. Other embodiments can utilize such a hybrid power system in other types of vehicles, such as, but not limited to, watercraft and aircraft vehicles. Cooling system 110 is particularly configured to cool designated portions of the hybrid power system that includes, for example, an engine generator unit 105, a battery bank 120, and a power converter, such as but not limited to, an inverter assembly 140. The hybrid power system also can be seen to include an input for shore power 145. These hybrid power system components are operatively coupled to develop and manage the power requirements of RV 100.

In one embodiment, engine generator unit 105 can include a variable speed engine 130 and be designed to deliver a desired amount of energy. Generator engine 130 receives fuel such as diesel, natural gas or liquid propane vapor through an intake. Generator engine 130 is coupled to an alternator (not shown) such that as a crankshaft is rotated by the operation of engine generator 130, the crankshaft drives the alternator which, in turn, converts the mechanical energy generated by generator engine 130 to electrical power for transmission and distribution throughout the RV 100.

Cooling system 110 further includes a radiator 202 operatively connected to generator engine 130 such that engine coolant from generator engine 130 circulates through radiator 202 during operation of generator engine 130. Air passes over the radiator 202 so as to effectuate a heat exchange between generator engine coolant flowing through radiator 202 and the air. In order to draw air over radiator 202, cooling system 110 can include a fan (not shown) to draw air across radiator 202 so as to cool generator engine 130 and the engine coolant flowing through the radiator 202.

Battery bank 120 can include any desired number, typically six or more 12V batteries located at a rear portion of the RV 100. These batteries deliver, for example, a nominal 12 V DC to power converter/inverter assembly 140 which converts the DC to AC power to help power the energy load required by RV 100, along with the energy supplied via the engine generator unit 105. The power from inverter assembly 140 and the engine generator unit 105 is managed by an energy management system control assembly 142 that helps store, manage, and deliver the energy load requirements of the RV 100.

A hybrid power system such as depicted in FIG. 1 requires extensive cooling since the heat level developed by inverter assembly 140 and generator engine 130 can be very high. In this embodiment, inverter assembly 140 is designed with a cooling plate 144. Cooling plate 144 receives coolant from the front portion of the RV 100 via a coolant line such as a hose 152. Cooling plate 144 is incorporated into inverter assembly 140 and is adapted to provide enough cooling to allow the use of the inverter assembly 140 in the hybrid power system. In this embodiment, inverter assembly 140 is most preferably located near the battery bank 120, which traditionally resides in the rear portion of Class A coaches, such as RV 100, while the engine generator unit 105 has traditionally been located in the undercarriage slide-out at the front of the RV 100. Accordingly, coolant flows to the inverter assembly 140 via coolant hose 152 and back to a heat exchanger 204 via coolant hose 154.

Figure 2:
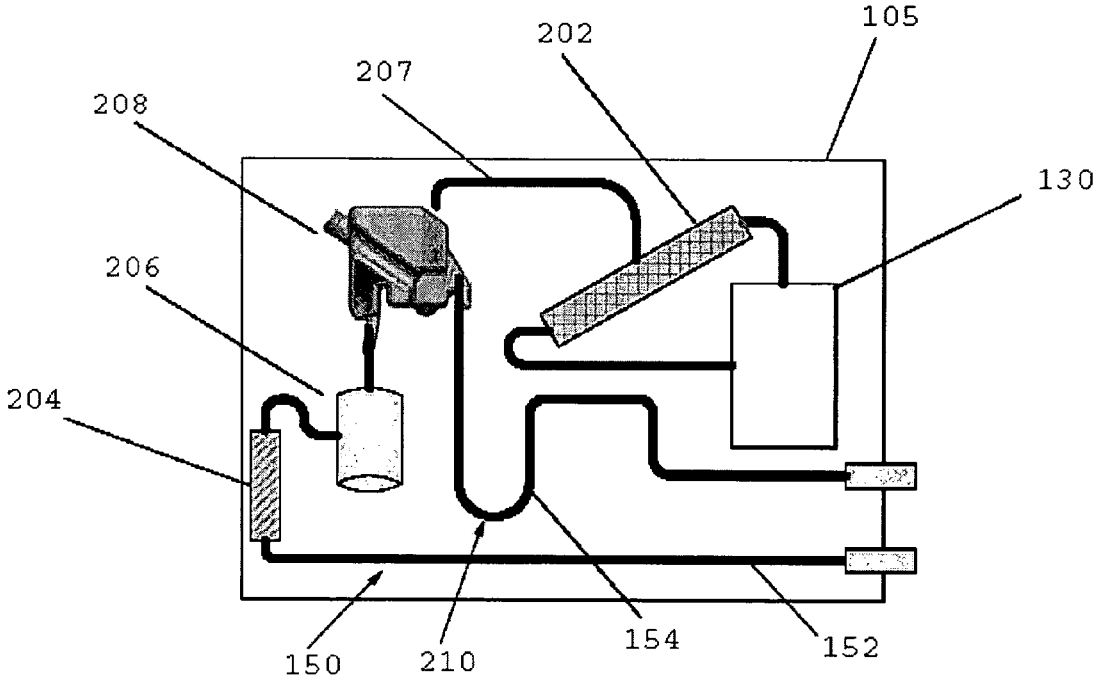
FIG. 2 is a schematic view of a portion of the hybrid power system and its associated cooling system shown in FIG. 1.
Figure 3:
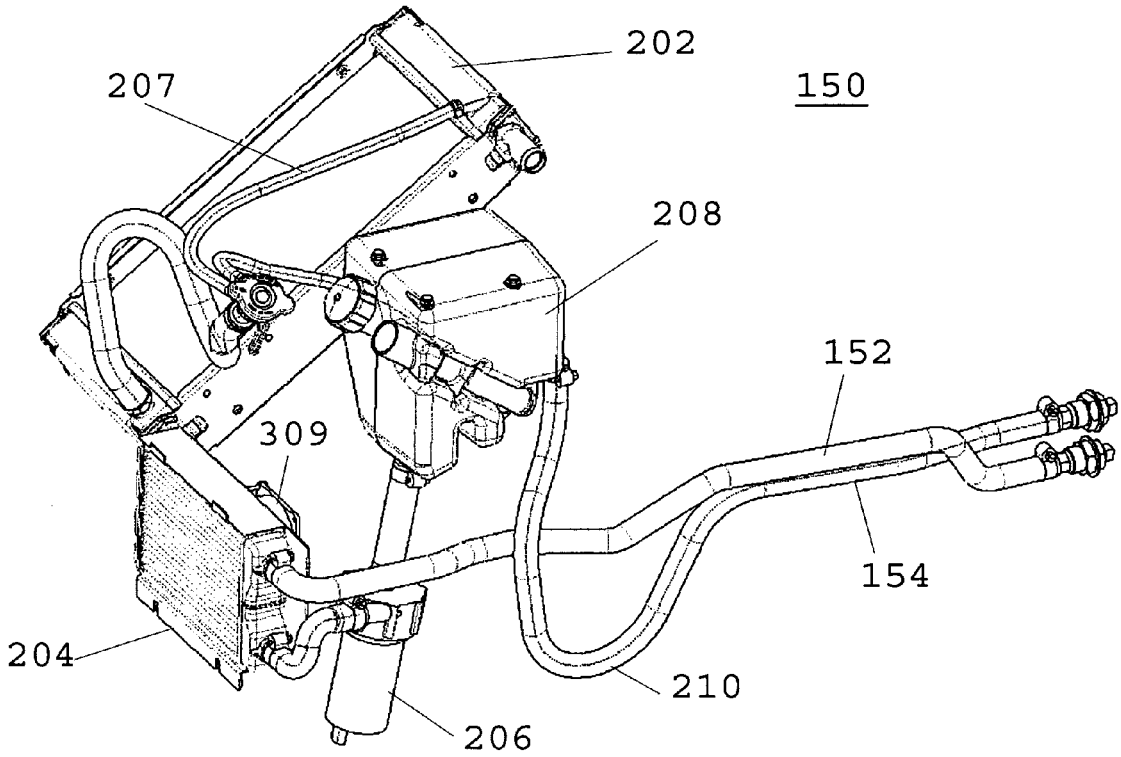
FIG. 3 is a perspective view of the portion of the hybrid power system and its associated cooling system shown in FIG. 2.

FIG. 2 is a schematic view illustrating the engine generator cooling system 150; and FIG. 3 is a perspective view of the engine generator cooling system 150 shown in FIG. 2. Engine generator cooling system 150 utilizes the access to the cooling air provided to generator engine radiator 202 along with a heat exchanger 204 and a pump 206, and transfers the cooling liquid using hoses 152 and 154 to and from inverter assembly 140 such as depicted in FIG. 1 to the frontally mounted engine generator unit 105.

Engine generator cooling system 150 generally includes generator engine radiator 202, heat exchanger 204, a coolant pump 206, and a coolant tank 208. Engine generator cooling system 150 is designed such that the single coolant tank 208 is operatively coupled to both the generator engine 130 and the inverter assembly 140 such as depicted in FIG. 1. This allows for space saving within the front of RV 100 and provides both, manufacturing and maintenance advantages including, but not limited to, for example, the elimination of any necessity to provide undesirably large current carrying capacity power cables.

In one embodiment, for example, coolant flows in a first cooling circuit between generator engine 130 and generator engine radiator 202 with coolant overflow being directed to coolant tank 208 via an overflow hose 207. In a second cooling circuit, coolant to the inverter assembly 140, such as depicted in FIG. 1, flows from coolant tank 208 through coolant pump 206, through heat exchanger 204 and back to the inverter assembly 140 via hose 152 and back to the coolant tank 208 via hose 154, which is coupled to coolant tank 208.

In one embodiment, coolant pump 206 is positioned below coolant tank 208 such that pump 206 has a head pressure when the pump 206 is first turned on. The location of pump 206 thus facilitates system filling via a non self-priming pump.

Heat exchanger 204 receives coolant from the pump 206. A fan 309, shown in FIG. 3, can be used in some embodiments to provide further cooling within heat exchanger 204.

Accordingly, coolant tank 208 performs a dual purpose by acting as a generator engine coolant overflow for the generator engine cooling circuit and acting as an expansion and pressure head tank for the inverter assembly cooling circuit.

In one embodiment, upstream coolant return hose 154 includes a coolant trap 210. For example, return hose 154 can include an excess length of hose in order to form a trap for the coolant, such as a J-trap. Trap 210 can contain the amount of fluid available to the generator engine 130 suitable for testing purposes. This allows the generator engine 130 to be tested before shipping, and then if any coolant is sloshed out of the tank 208 and into the coolant hose 154 during shipping, the trap 210 will contain the coolant. On the other hand, heat exchanger 204 acts a trap downstream of tank 208. Accordingly, an operator at the OEM should see little if any coolant liquid upon removal of hose plugs that may be employed as a maintenance feature associated with coolant hoses 152, 154. Accordingly, the engine generator cooling system 150 includes means to utilize overflow functions and to maintain a dry header tank for assembly and testing purposes.

Figure 4:
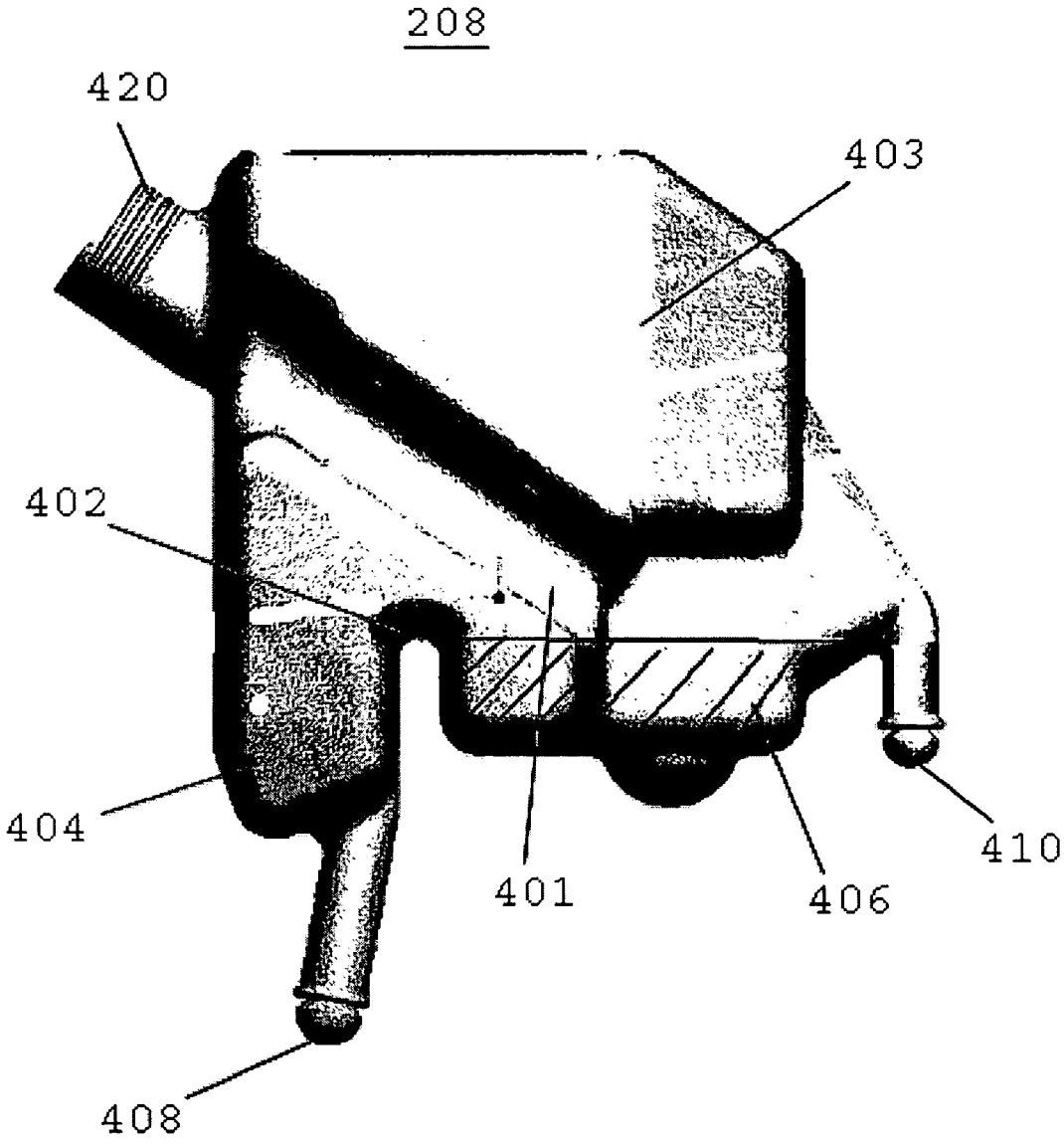
FIG. 4 shows a side view of a coolant tank suitable for use with the hybrid power system shown in FIGS. 1-3, in accordance with one embodiment.

FIG. 4 shows a side view of coolant tank 208, in accordance with one embodiment. As discussed, coolant tank 208 is a common tank used for both generator engine 130 coolant overflow and inverter assembly 140 electronics cooling as well as an expansion and pressure head tank for the inverter assembly 140 cooling circuit. Again, this advantageously saves both space and money. In one embodiment, coolant tank 208 includes a molded plastic body defining an internal reservoir 401. The internal reservoir 401 is divided into an upper common volume or chamber 403 and two lower divided volumes or chambers 404 and 406, which are divided by a wall, such as dam 402. In use, coolant leaves tank 208 to cool the inverter assembly cooling circuit through outlet 408 and returns through inlet 410. Outlet 408 is at the bottom of first chamber 404 and inlet 410 feeds coolant into second chamber 406.

Tank 208 includes enough volume in the second coolant chamber 406 to allow for expansion of the volume of fluid required by the generator engine 130 (for example, fluid in the generator engine block, radiator 202, and hoses). Thus, as the coolant expands with temperature, the excess fluid enters chamber 406 of the tank 208. If more comes in, it can overflow dam 420 into chamber 404 or merely fill up more of the common volume area 403. However, if any of the inverter assembly cooling circuit coolant hoses leak somewhere in the system, the generator engine 130 will never be without coolant because of chamber 406 and dam 402, since the amount of coolant in chamber 406 will be prevented from entering the inverter coolant cooling circuit though outlet 408. Moreover, extra chamber 406 allows the generator engine 130 to be tested before leaving the plant. This is because the entire system does not need to be filled with coolant, other than just enough to run the generator engine 130. Then as noted above, when an OEM gets the system, the coolant will either be in tank 208 or maybe in the coolant trap 210 discussed above.

In one embodiment, tank 208 includes a cap to seal the tank at a fill port 420. To test the system, tank 208 is pressurized through the overflow hose 207 depicted in FIGS. 2 and 3. The pressure is then removed so that tank 208 is able to operate at atmospheric pressure. The inlet and outlet ports 408 and 410 are plugged during assembly and removed by the OEM operator.

Moreover, referring again to FIGS. 1, 2, and 3, the 3-D footprint of the present cooling design allows for ease of maintenance and service. For example, the system is designed and laid out such that items requiring service are located at the bottom of the system. These include pump 206, radiator 204 and hoses 154 and 152, for example. Conversely, maintenance items are located at the easily accessible top portion of the system. These include the fill portions inputs of radiator 202 and overflow tank 280, for example. Thus, the layout provides ease of service and maintenance within a small overall 3-D footprint.

The above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A cooling system comprising:

an engine;

an engine cooling circuit to deliver coolant to the engine;

a power converter;

a power converter cooling circuit to deliver coolant to the power converter; and a coolant tank operatively coupled to both the engine cooling circuit and the power converter cooling circuit, the coolant tank including an overflow inlet port configured to receive coolant overflow from the engine, the coolant tank further having a coolant inlet port configured to receive coolant from the power converter cooling circuit and further having a coolant outlet port configured to deliver coolant to the power converter cooling circuit, the coolant tank further having a first chamber leading to the coolant outlet port and a second chamber configured to receive coolant via the coolant inlet port, wherein the first chamber and the second chamber are separated by a wall, the coolant inlet port being at a bottom portion of the second chamber.

2. The cooling system according to claim 1, wherein the coolant tank holds engine coolant overflow and also operates as an expansion and pressure head tank for the power converter cooling circuit.

3. The cooling system according to claim 1, wherein the engine is configured to develop electrical energy.

4. The cooling system according to claim 1, wherein the power converter is coupled to a bank of DC batteries.

5. The cooling system according to claim 1, wherein the power converter and engine are operatively coupled to an electrical energy delivery system.

6. The cooling system according to claim 1, wherein the coolant tank includes an input from a radiator, the radiator located between the engine and the coolant tank.

7. The cooling system according to claim 6, wherein the coolant tank includes an outlet to a pump to drive coolant through the power converter cooling circuit, the coolant tank further including an inlet from the power converter cooling circuit.

8. The cooling system according to claim 7, wherein the pump is located at a lower elevation than the coolant tank.

9. The cooling system according to claim 7, wherein a coolant hose leading to the coolant tank inlet includes a coolant trap.

10. The cooling system according to claim 1, wherein the power converter comprises an inverter operational to convert DC current to AC current.

11. A cooling system comprising a coolant tank including an overflow inlet port configured to receive coolant overflow from an engine, the coolant tank further having a coolant inlet port configured to receive coolant from a power converter cooling circuit and further having a coolant outlet port configured to deliver coolant to the power converter cooling circuit, the coolant tank further having a first chamber leading to the coolant outlet port and a second chamber configured to receive coolant via the coolant inlet port, wherein the first chamber and the second chamber are separated by a wall.

12. The cooling system according to claim 11, wherein the coolant tank further includes a filling inlet to fill with coolant.

13. The cooling system according to claim 11, wherein the wall has a height of at least two inches.

14. The cooling system according to claim 11, wherein the coolant outlet port is at a bottom portion of the first chamber.

15. The cooling system according to claim 11, wherein coolant inlet port is at a bottom portion of the second chamber.

16. The cooling system according to claim 11, wherein the second chamber having an opening and being connected to the coolant inlet port at the opening, the opening being above a height of the wall.

17. A cooling system comprising:

an engine;

an engine cooling circuit to deliver coolant to the engine;

a power converter;

a power converter cooling circuit including a coolant pump to deliver coolant to the power converter; and a coolant tank operatively coupled to both the engine cooling circuit and the power converter cooling circuit, wherein the pump is located at a lower elevation than die coolant tank, wherein the tank holds engine coolant overflow and operates as an expansion and pressure head tank for the power converter cooling circuit.

18. The cooling system according to claim 17, wherein the coolant tank includes an input from a radiator, the radiator between the engine and the coolant tank.

19. The cooling system according to claim 17, wherein the coolant tank includes an outlet to the pump to drive coolant through the power converter cooling circuit, the coolant tank further including an inlet from the power converter cooling circuit.

20. The cooling system according to claim 19, wherein a coolant hose leading to the coolant tank inlet includes a coolant trap.

21. The cooling system according to claim 17 wherein the engine is a generator engine and further wherein the power converter is an inverter operational to convert DC current to AC current.

* * * * *